US010711467B1

(12) United States Patent
Britton et al.

(10) Patent No.: US 10,711,467 B1
(45) Date of Patent: Jul. 14, 2020

(54) LINKABLE TILES FOR COVERING A SURFACE

(71) Applicants: Jeremy Britton, Riverside, CA (US); Jacob Olsson, Riverside, CA (US); Domanic Chu, Alhambra, CA (US)

(72) Inventors: Jeremy Britton, Riverside, CA (US); Jacob Olsson, Riverside, CA (US); Domanic Chu, Alhambra, CA (US)

( * ) Notice: Subject to any disclaimer, the term of this patent is extended or adjusted under 35 U.S.C. 154(b) by 0 days.

(21) Appl. No.: 16/736,371

(22) Filed: Jan. 7, 2020

Related U.S. Application Data

(60) Provisional application No. 62/936,470, filed on Nov. 16, 2019.

(51) Int. Cl.

| | |
|---|---|
| ***E04F 15/00*** | (2006.01) |
| ***E04F 15/02*** | (2006.01) |
| ***E04B 1/61*** | (2006.01) |
| *E04B 1/41* | (2006.01) |

(52) U.S. Cl.
CPC ..... *E04F 15/02038* (2013.01); *E04B 1/6104* (2013.01); *E04B 1/40* (2013.01); *E04B 1/54* (2013.01); *E04F 2201/0529* (2013.01); *E04F 2201/06* (2013.01); *Y10T 428/192* (2015.01); *Y10T 428/195* (2015.01)

(58) Field of Classification Search
CPC ..... Y10T 428/192; Y10T 428/195; E04F 13/0883; E04F 15/02144; E01C 5/00–22; E01C 11/00–26
See application file for complete search history.

(56) References Cited

U.S. PATENT DOCUMENTS

| | | | | |
|---|---|---|---|---|
| 4,561,232 | A | 12/1985 | Gladden, Jr. et al. | |
| 9,181,717 | B1 | 11/2015 | Jamison | |
| 9,890,540 | B2 | 2/2018 | Weitzer | |
| 10,208,489 | B2 | 2/2019 | Walens et al. | |
| 2008/0202053 | A1 | 8/2008 | Guy et al. | |
| 2014/0227934 | A1* | 8/2014 | Rudisill | A63H 33/046 446/92 |
| 2019/0013131 | A1 | 1/2019 | Smith et al. | |

FOREIGN PATENT DOCUMENTS

| | | | |
|---|---|---|---|
| GB | 2564104 | A | 1/2019 |
| KR | 101330389 | B1 | 11/2013 |
| WO | 2018195002 | A1 | 10/2018 |

* cited by examiner

*Primary Examiner* — Alexander S Thomas
(74) *Attorney, Agent, or Firm* — Umberg Zipser LLP

(57) ABSTRACT

Various embodiments of flooring and other tiles are described that comprise one or more magnets and/or routed edges to connect adjacent tiles to one another. Some tiles may comprise a set of magnets or magnetized portions to connect with an adjacent tile having a set of magnets of opposite polarity.

8 Claims, 5 Drawing Sheets

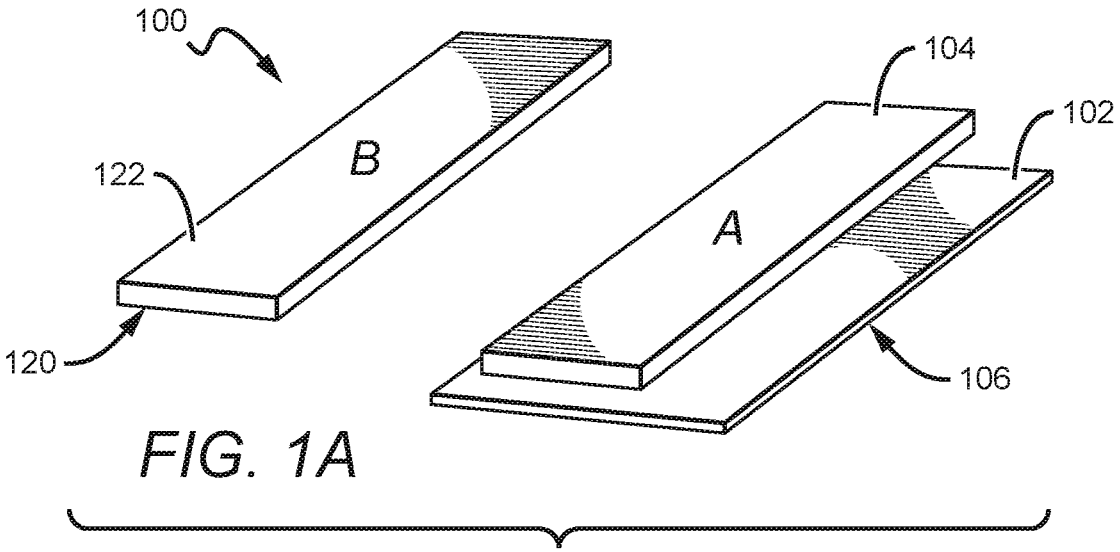
FIG. 1A
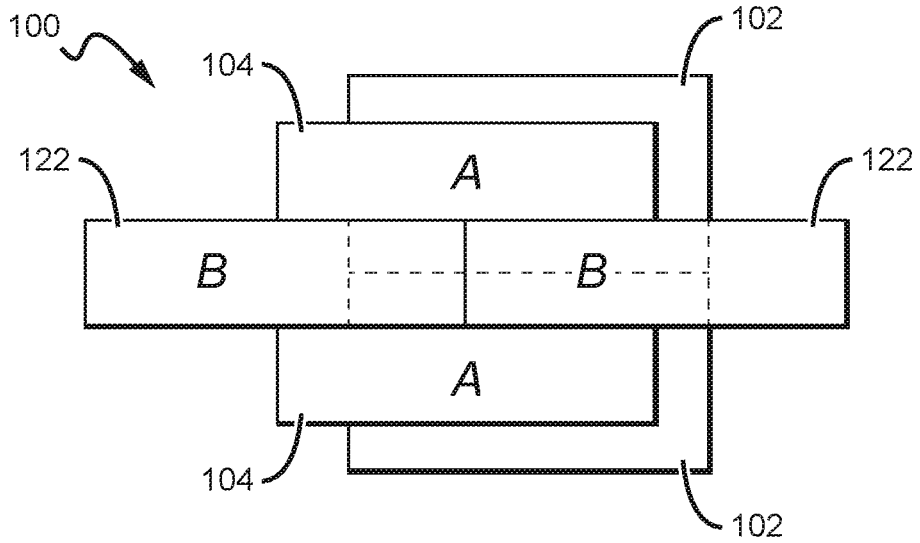
FIG. 1B
FIG. 1C
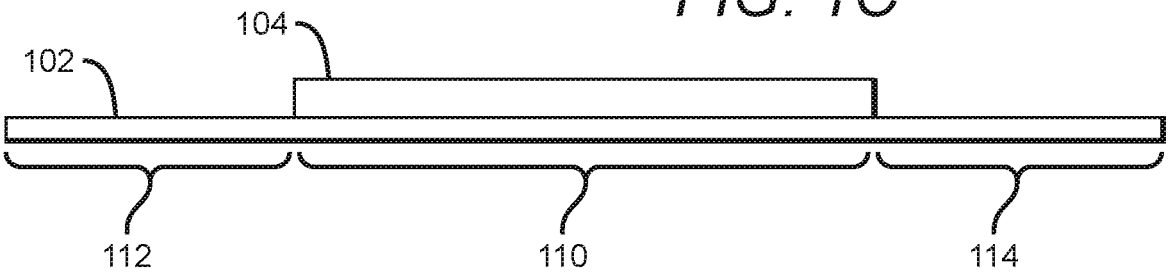

FIG. 3A
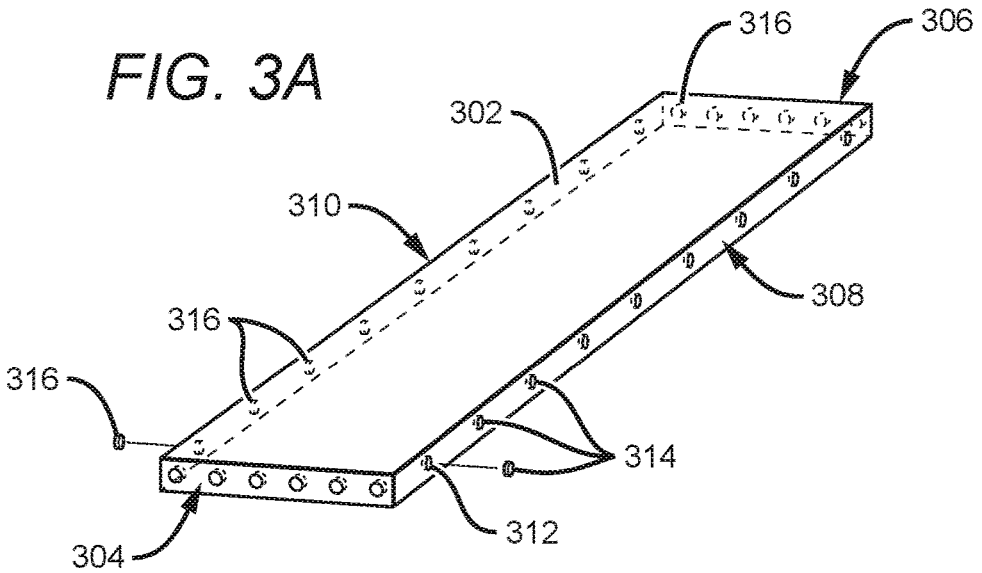
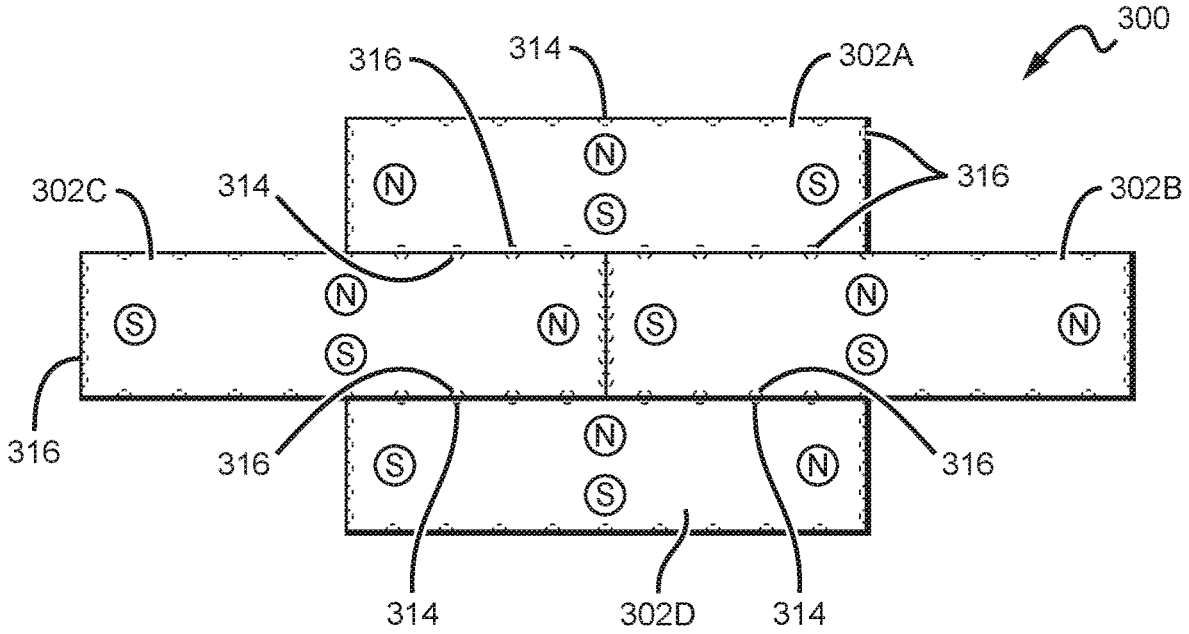
FIG. 3B
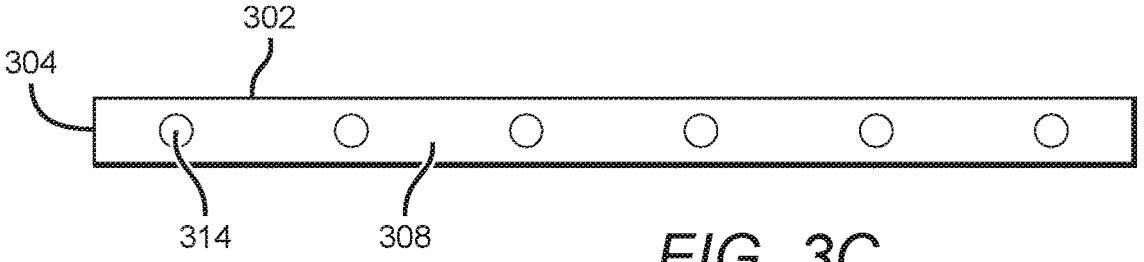
FIG. 3C

LINKABLE TILES FOR COVERING A SURFACE

This application claims priority to U.S. provisional application having Ser. No. 62/936,470 filed on Nov. 16, 2019. This and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is flooring tiles.

BACKGROUND

The following description includes information that may be useful in understanding the present invention. It is not an admission that any of the information provided herein is prior art or relevant to the presently claimed invention, or that any publication specifically or implicitly referenced is prior art.

In general, flooring tiles and other interlocking tiles comprise a first side with routed edges that are used to interlock adjacent tiles by holding the adjacent tile against the other tile at a slight angle and then pushing the adjacent tile to lock the two tiles together. This solution can prevent quick removal of a single piece of the interlocked tiles due to the nature of each tile being interlocked with neighboring tiles.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

Thus, there is still a need for linkable tiles having improved mechanisms for linking adjacent tiles.

SUMMARY OF THE INVENTION

The inventive subject matter provides apparatus, systems and methods for tiles for covering a surface. In preferred embodiments, a set of tiles are coupled together to form a covering for a surface onto which they are laid. Such surface could comprise a floor, but could alternatively comprise a wall or other surface.

In some embodiments, the tile comprises a composite piece disposed on top of a vinyl sheet and attached to one another. Preferably, a surface area of the vinyl sheet is greater than a surface area of the composite piece. The composite piece is disposed on top of the vinyl sheet in an offset manner, such that a portion of the composite piece is disposed off the vinyl sheet. At least one of the vinyl sheet and composite piece comprises a magnetized portion.

In preferred embodiments, a portion of the vinyl sheet, and preferably not the portion beneath the composite sheet, comprises the magnetized portion. In this manner, two of these tiles can be placed such that the vinyl sheet of each abuts on one side. A second tile having a set of magnets on a lower surface of the second tile can be placed on at least part of the magnetized portion of the vinyl sheet of each of the two tiles. In this manner, the magnets on the lower surface of the second tile can be coupled to the adjacent vinyl sheets such that the three tiles are coupled with the second tile disposed in between the two other tiles.

In another embodiment, the tile comprises first, second, third and fourth sides, with the first and second sides disposed opposite of each other, and the third and fourth sides disposed opposite of each other. In such embodiment, the third and fourth sides are disposed between the first and second sides. The first side preferably comprises a first routed edge having a first slot with first and second opposing inner edges, such that a width of an inner surface of the first slot is greater than a width of an opening of the first slot in the first side.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWINGS

FIGS. 1A-1C illustrate various views of one embodiment of a tile.

FIGS. 3A-3C illustrate various views of another embodiment of a tile.

DETAILED DESCRIPTION

Figure 2A:
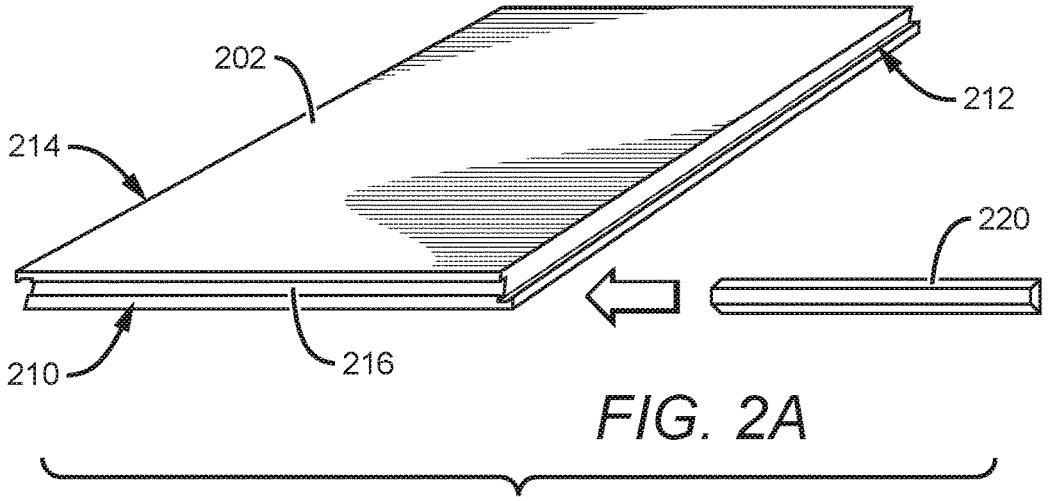
FIGS. 2A-2C illustrate various views of another embodiment of a tile.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

FIGS. 1A-1C illustrate one embodiment of a flooring system 100 for covering a floor or other surface that comprises a first set of tiles A and a second set of tiles B. Although referred to as a flooring system, it is contemplated that the tiles could be used to cover a wall or other surface in addition to flooring.

The first set of tiles A comprises a composite piece 104 that is disposed on top of a vinyl sheet 102. Preferably, a surface area of the vinyl sheet 102 is greater than a surface area of the composite piece 104. It is especially preferred that the composite piece 104 is disposed on top of the vinyl sheet 102 in an offset manner, such that a portion of the composite piece 104 is disposed off the vinyl sheet 102, such as shown in FIG. 1A.

It is preferred that at least one of the vinyl sheet 102 and composite piece 104 comprises a magnetized portion. In the embodiment shown in FIGS. 1A-1C, at least a portion of the vinyl sheet 102 is preferably magnetized to form the magnetized portion 106, and such portion is preferably the portion that is not disposed beneath composite piece 104. Thus, in such embodiments, the vinyl sheet 102 can comprise a first region 110 and a second region 112, wherein the composite piece 104 is disposed on top of the first region 110 and not the second region 112, and wherein the second region 112 comprises the magnetized portion 106. It is contemplated that the vinyl sheet 102 may also comprise a third region 114 on an opposite side of the composite piece 104, which may or may not be magnetized.

However, it is also contemplated that one or more of the sides of the composite piece 104 could comprise one or more magnets.

As discussed above, system 100 can also include a second set of tiles B, which are configured to couple with the tiles A of the first set, such as shown in FIG. 1B. Preferably each tile B of the second set comprises a set of magnets on a lower surface 120. In this manner, the set of magnets on the lower surface 120 magnetically couple with the magnetized surface 106 of the vinyl sheet 102 to thereby couple tile B to tile A.

As shown in FIG. 1B, composite piece 122 of tile B can be placed between adjacent tiles A to thereby connect the three tiles via the intermediate tile B. The tiles A,B,A can be coupled together via the interaction between at least some of the magnets on the lower surface 120 of composite piece 122 and the magnetized portions 106 of the vinyl sheet 102 of tiles A. As shown, tiles B are preferably placed in an offset manner relative to the composite pieces 104 of tiles A.

Although not shown, it is contemplated that one or more sides of the composite piece 122 could have a routed edge that interacts with a routed edge of composite piece 104 to thereby further secure the composite pieces 122 and 104 to one another.

Figure 2B:
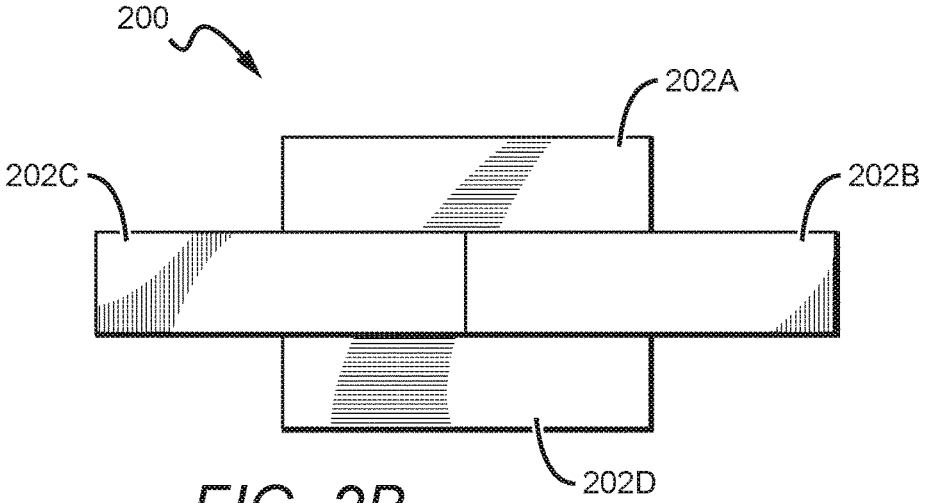
Figure 2C:
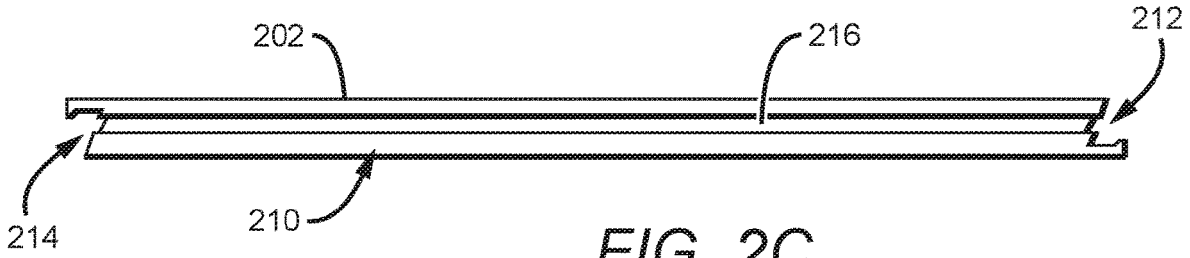

FIGS. 2A-2C illustrate another embodiment of a flooring system 200 for covering a floor or other surface that comprises a set of tiles 202. As shown in FIGS. 2A and 2C, each tile 202 comprises a composite piece having first, second, third and fourth sides forming a rectangular shape with the first and second sides disposed opposite of each other, and the third and fourth sides disposed opposite of each other. In such arrangement, the third side and fourth side are each disposed between the first and second sides.

The first side 210 comprises a routed edge having a slot 216 cut into the first side 210. The slot 216 preferably has first and second opposing sides that extend between an opening of the slot 216 on an outer surface of the first side 210 and an inner surface of the slot 216. A width or diameter of the inner surface of the slot 216 is preferably greater than a width or diameter of the opening of the slot 216.

As shown in FIGS. 2A and 2C, preferably the first and second opposing sides of slot 216 are tapered, such that a cross-section of the slot 216 comprises an isosceles trapezoid shape. In such embodiments, it is contemplated that the slot 216 is configured to receive an insert 220 having a set of magnets coupled to or embedded within the insert 220. Preferably, the insert 220 also comprise a cross-section having an isosceles trapezoid shape. In this manner, the insert 220 can be slidably engaged with the slot 216, and thereby held in place while providing magnets that be used to couple the side 210 of the tile 202 with an adjacent tile having one or more magnets or magnetized surface.

Alternatively, it is contemplated that the slot 216 could comprise a T-shape, an L-shape, or other suitable shape, such that a width or diameter of the inner surface of the slot 216 remains greater than a width or diameter of the opening of the slot 216.

Tile 202 can include a third side having a routed edge 212 and a fourth side having a routed edge 214. Preferably, the routed edge 212 is complementary to the routed edge 214, such that routed edge 214 of an adjacent tile can be connected with routed edge 212 of the tile 202. The adjacent tiles may be coupled in an interlocking manner where the edges are placed together and then moved relative to one another to lock the tiles in place. In such embodiments, it is contemplated that the insert 220 can be used to help prevent the side 210 of the tile 202 from raising or warping over time by the use of the magnetic coupling with an adjacent tile.

It is further contemplated that the second side (opposite of the first side 210) can have a routing to form a slot similar to that of slot 216, and that is configured to receive an insert much like insert 220. In this manner, two of the sides (first and second sides) can have a set of magnets or otherwise be magnetized, and the other two sides (third and fourth sides) can have a routed edge that permits interlocking of an adjacent tile.

As shown in FIG. 2B, multiple tiles 202A-202D can be connected to adjacent tiles to form a flooring. For example, tile 202A can be connected to tiles 202C and 202B via the routed edges of those tiles. Likewise, tile 202D can be connected to tiles 202C and 202B via the routed edges of those tiles. Tiles 202B and 202C can be magnetically coupled to one another via the inserts 220.

FIGS. 3A-3C illustrate another embodiment of a flooring system 300 for covering a floor or other surface that comprises a set of tiles 302. As shown in FIGS. 3A and 3C, each tile 302 comprises a composite piece having a first side 304, a second side 306, a third side 308, and a fourth side 310 forming a rectangular shape with the first and second sides 304, 306 disposed opposite of each other, and the third and fourth sides 308, 310 disposed opposite of each other. In such arrangement, the third side and fourth sides 308, 310 are each disposed between the first and second sides 304, 306.

Each of the sides preferably comprises a set of recessed or notches configured to receive a magnet. Preferably, the magnets are arranged such that the first and third sides 304, 308 have a first polarity and the second and fourth sides 306, 310 have the opposite polarity. Thus, the first and third sides 304, 308 comprises a set of magnets 314 disposed such that the north pole of the magnets 314 face outwardly, and the second and fourth sides 306, 310 comprises a set of magnets 316 disposed such that the south pole of the magnets 316 face outwardly. Of course, the polarity of the magnets of the first and third sides 304, 308 could be swapped with the magnets of the second and fourth sides 306, 310 without departing from the scope of the invention.

As shown in FIG. 3B, multiple tiles 302A-302D can be connected to adjacent tiles to form a flooring. For example, tile 302A can be connected to tiles 302B and 302C via magnets 316 on the fourth side of the tile 302A, and magnets 314 on the second side of tiles 302B and 302C. Likewise, tile 302D can be connected to tiles 302B and 302C via magnets 314 on the second side of the tile 302D, and magnets 316 on the fourth side of tiles 302B and 302C. Tiles 302B and 302C can be magnetically coupled to one another via magnets 314 on the first side of tile 302C and magnets 316 on the second side of tile 302B.

Figure 4A:
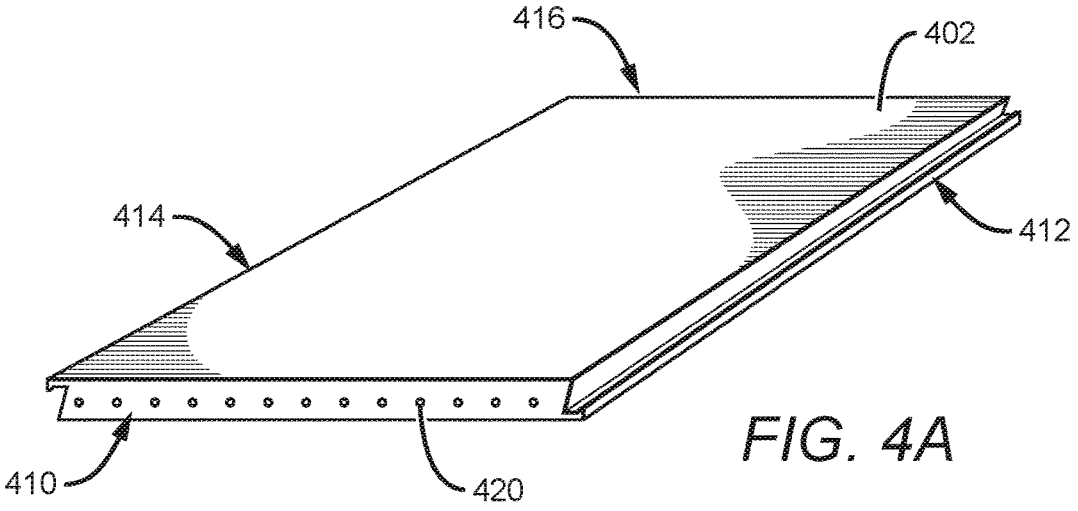
FIGS. 4A-4C illustrate various views of another embodiment of a tile.
Figure 4B:
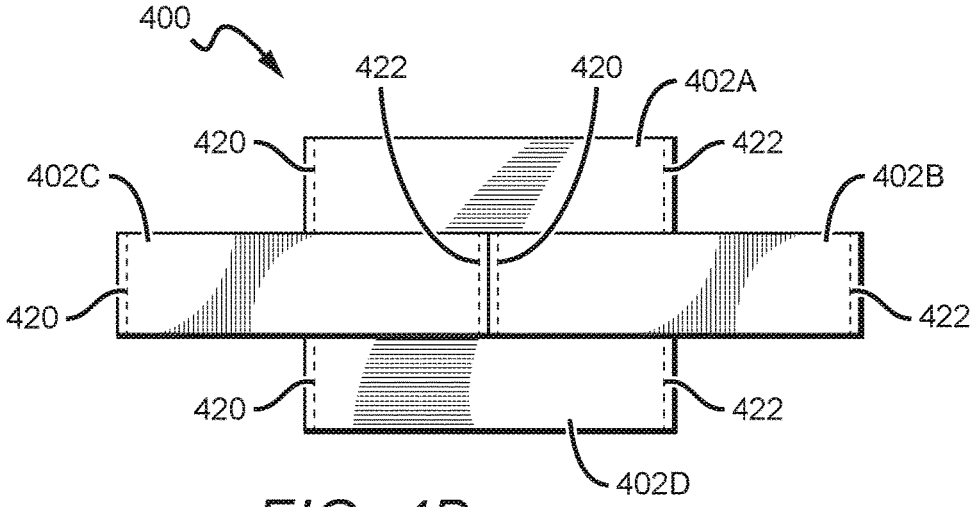
Figure 4C:
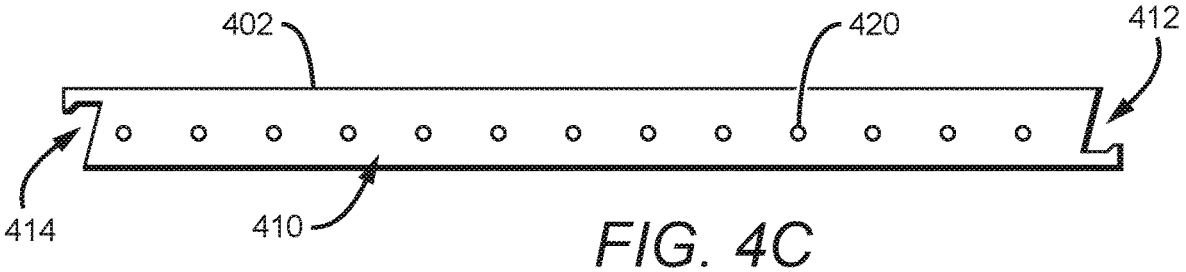

FIGS. 4A-4C illustrate another embodiment of a flooring system 400 for covering a floor or other surface that comprises a set of tiles 402. As shown in FIGS. 4A and 4C, each tile 402 comprises a composite piece having a first side 410, a second side 416, a third side 412, and a fourth side 414 forming a rectangular shape with the first and second sides 410, 416 disposed opposite of each other, and the third and fourth sides 412, 414 disposed opposite of each other. In such arrangement, the third side and fourth sides 412, 414 are each disposed between the first and second sides 410, 416.

The first side 410 preferably comprises a set of magnets 420 embedded or otherwise coupled to the first side 410. Similarly, the second side 416 can comprise a second set of magnets 422 having a polarity that is opposite those of the set of magnets 420.

Tile 402 can include a third side 412 having a first routed edge and a fourth side 414 having a second routed edge. As shown, the first and second routed edges can be complementary to one another, such that a first routed edge of a first tile can connect and interlock with a second routed edge of an adjacent tile. The adjacent tiles may be coupled in an interlocking manner where the edges are placed together and then moved relative to one another to lock the tiles in place. In such embodiments, it is contemplated that the interaction of magnets 420 of one tile and magnets 422 of the adjacent tile can be used to help prevent the first and second sides of the tiles from raising or warping over time by the use of the magnetic coupling with adjacent tiles.

Thus, like the tile shown in FIGS. 2A and 2C, two of the sides (first and second sides) can have a set of magnets or otherwise be magnetized, and the other two sides (third and fourth sides) can have a routed edge that permits interlocking of an adjacent tile.

As shown in FIG. 4B, multiple tiles 402A-402D can be connected to adjacent tiles to form a flooring. For example, tile 402A can be connected to tiles 402C and 402B via the routed edges of those tiles. Likewise, tile 402D can be connected to tiles 402C and 402B via the routed edges of those tiles. Tiles 402B and 402C can be magnetically coupled to one another via magnets 420 and magnets 422, respectively.

Figure 5A:
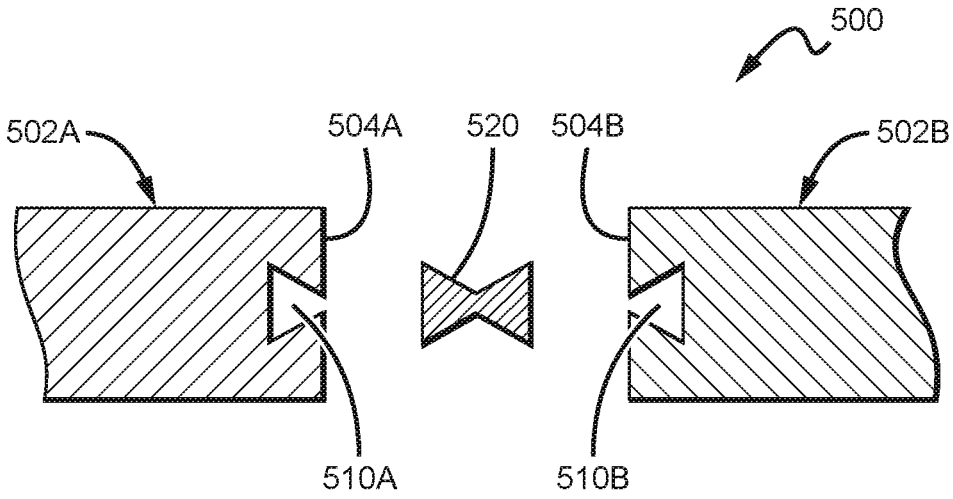
FIGS. 5A-5B illustrate side views of another embodiment of a tile.
Figure 5B:
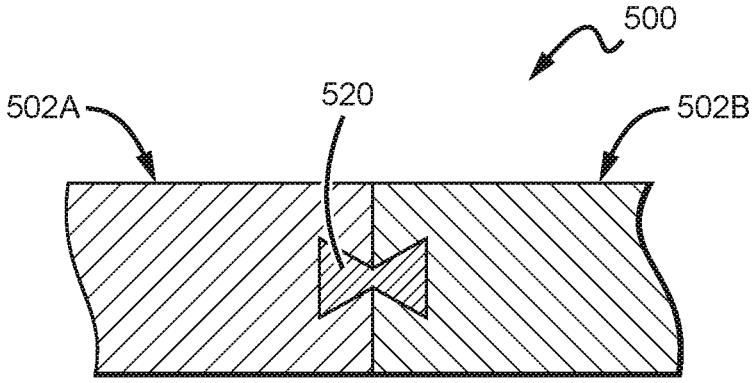

FIGS. 5A-5B illustrate another embodiment of a flooring system 500 for covering a floor or other surface that comprises a set of tiles 502A, 502B. Tile 502A can have a first side 504A with a slot 510A formed in the side 504A. Similarly, tile 502B can have a first side 504B with a slot 510B formed in the side 504B.

Slots 510A, 510B preferably comprises first and second opposing sides that extend between an opening of each slot 510A, 510B on an outer surface of the first side 504A, 504B, respectively, and an inner surface of the each slot 510A, 510B. A width or diameter of the inner surface of each slot 510A, 510B is preferably greater than a width or diameter of the opening of each slot 510A, 510B.

As shown, preferably the first and second opposing sides of each slot 510A, 510B are tapered, such that a cross-section of each slot 510A, 510B comprises an isosceles trapezoid shape. In such embodiment, it is contemplated that each slot 510A, 510B is configured to receive a portion of an insert 520.

When the insert 520 is received by both of the slots 510A, 510B, tile 502A and tile 502B are connected to one another.

Alternatively, it is contemplated that the slots 510A, 510B could comprise a T-shape, an L-shape, or other suitable shape, such that a width or diameter of the inner surface of the each slot 510A, 510B remains greater than a width or diameter of the opening of each slot 510A, 510B. In such embodiments, it is contemplated that the shape of the insert could be likely varied to an I-shape (for T-shaped slots) or a C-shape (for L-shaped slots), for example.

Although not shown, it is contemplated that each of tiles 502A and 502B can include opposing sides having routed edges that are preferably complementary to one another, such that routed edge of one tile can be connected with routed edge of the adjacent tile.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A device for covering a surface, comprising:

a piece first, second, third and fourth sides, wherein the first and second sides are disposed opposite of each other, and the third and fourth sides are disposed opposite of each other and are disposed between the first and second sides;

a first set of magnets coupled to the first side;

a second set of magnets coupled to the second side; and wherein the first set of magnets is configured to magnetically couple with a set of magnets of an adjacent tile having a third set of magnets;

a first routed edge disposed on the first side and having a first slot with first and second opposing inner edges, such that a width of an inner surface of the first slot is greater than a width of an opening of the first slot at the first side;

a second routed edge disposed on the second side and having a second slot with third and fourth opposing inner edges, such that a width of an inner surface of the second slot is greater than a width of an opening of the second slot in the second side;

a first insert sized and diminished to be slidably received within the first slot, wherein the first set of magnets are embedded in the first insert; and second insert sized and dimensioned to be slidably received within the second slot, wherein the second set of magnets are embedded in the second insert.

2. The device of claim 1, wherein the first set of magnets have a first polarity, and wherein the second set of magnets have a polarity opposite of the first polarity.

3. The device of claim 2, further comprising:

a third set of magnets coupled to the third side;

a fourth set of magnets coupled to the fourth side; and wherein the first and third sets of magnets have the same polarity, and wherein the second and fourth sets of magnets have the same polarity that is opposite that of the first and third sets of magnets.

4. The device of claim 1, wherein the third and fourth sides each comprises a routed edge that are inverse to one another, such that a routed edge of a fourth side of an adjacent tile can be interlocked with the routed edge of the third side.

5. The device of claim 1, wherein each of the first and second opposing inner edges are tapered outwardly from an outward surface of the first side, such a cross-section of the first slot comprises an isosceles trapezoid shape.

6. The device of claim 5, wherein the first insert comprises a cross-section having an isosceles trapezoid shape.

7. The device of claim 1, wherein a cross-section of the first slot comprises a T-shape.

8. The device of claim 1, further comprising a third set of magnets that are embedded within the third side, and a fourth set of magnets that are embedded within the fourth side.

* * * * *